US009345271B2

(12) United States Patent
Collins et al.

(10) Patent No.: US 9,345,271 B2
(45) Date of Patent: May 24, 2016

(54) KNITTED COMPRESSION GARMENT, KNITTED FABRIC AND METHOD OF KNITTING FABRIC

(71) Applicants: Larry Wayne Collins, Connelly Springs, NC (US); Joachim Dietmar Adolf Bauer, Hamburg (DE); Kevin Michael Tucker, Hickory, NC (US); Phillip Todd Clark, Granite Falls, NC (US)

(72) Inventors: Larry Wayne Collins, Connelly Springs, NC (US); Joachim Dietmar Adolf Bauer, Hamburg (DE); Kevin Michael Tucker, Hickory, NC (US); Phillip Todd Clark, Granite Falls, NC (US)

(73) Assignee: BSN MEDICAL, INC., Charlotte, NC (US)

( * ) Notice: Subject to any disclaimer, the term of this patent is extended or adjusted under 35 U.S.C. 154(b) by 698 days.

(21) Appl. No.: 13/724,045

(22) Filed: Dec. 21, 2012

(65) Prior Publication Data

US 2014/0173808 A1 Jun. 26, 2014

(51) Int. Cl.

| | |
|---|---|
| ***A41B 11/12*** | (2006.01) |
| ***A41B 11/00*** | (2006.01) |
| ***D04B 1/18*** | (2006.01) |
| ***D04B 1/26*** | (2006.01) |

(52) U.S. Cl.

CPC ..... *A41B 11/121* (2013.01); *A41B 11/00* (2013.01); *D04B 1/18* (2013.01); *D04B 1/265* (2013.01)

(58) Field of Classification Search

CPC ..... A41B 11/00; A41B 11/12; A41B 11/02; A41D 17/00; D04B 9/54; D04B 1/26; D04B 11/00

USPC ..... 2/239, 240, 241, 242; 66/172 E, 178 A, 66/183

See application file for complete search history.

(56) References Cited

U.S. PATENT DOCUMENTS

| | | | | |
|---|---|---|---|---|
| 3,122,906 A | | 3/1964 | Crawford | |
| 3,187,522 A | | 6/1965 | Knohl | |
| 3,392,553 A | | 7/1968 | Burleson | |
| 3,466,667 A | | 9/1969 | Rosner | |
| 3,624,841 A | | 12/1971 | Lewis | |
| 3,728,875 A | * | 4/1973 | Hartigan | D04B 1/18 66/172 E |
| 3,874,001 A | * | 4/1975 | Patience | A61F 13/08 2/240 |

(Continued)

FOREIGN PATENT DOCUMENTS

| | | |
|---|---|---|
| EP | 0 556 068 A1 | 8/1993 |
| GB | 2 246 281 A | 1/1992 |
| WO | 2008/063259 A1 | 5/2008 |

OTHER PUBLICATIONS

Delta-Dry Application, BSN medical, Rev Jan. 2011.

(Continued)

*Primary Examiner* — Tejash Patel

(74) *Attorney, Agent, or Firm* — Shumaker, Loop & Kendrick, LLP

(57) ABSTRACT

A therapeutic medical garment having a variable pressure profile along its length, and including a knitted tubular body and a knitted anti-slip portion formed proximate one end of the tubular body with an inner surface adapted for residing against a wearer's skin. The knitted anti-slip portion includes at least first, second and third yarns simultaneously knitted to form a repeat having a raised surface texture on the inner surface of the anti-slip portion. One of the first, second and third yarns is a low-friction yarn, and two of the first, second and third yarns are high-friction yarns knitted to reside on and form the raised surface texture on the inner face of the anti-slip portion. A fabric construction and a method of forming a fabric construction are also disclosed.

14 Claims, 5 Drawing Sheets

(56) References Cited

U.S. PATENT DOCUMENTS

| | | | | | |
|---|---|---|---|---|---|
| 3,956,906 | A | | 5/1976 | Cassidy, Sr. | |
| 3,975,929 | A | * | 8/1976 | Fregeolle | D04B 1/265 2/239 |
| 3,983,870 | A | * | 10/1976 | Herbert | A41B 11/12 2/240 |
| 4,000,630 | A | | 1/1977 | Imboden | |
| 4,040,128 | A | | 8/1977 | Imboden | |
| 4,048,819 | A | * | 9/1977 | Johnson | D04B 1/243 66/172 E |
| 4,898,007 | A | * | 2/1990 | Dahlgren | A41B 11/003 2/239 |
| 5,572,888 | A | | 11/1996 | Browder, Jr. et al. | |
| D380,073 | S | | 6/1997 | Ruszczycki et al. | |
| 6,550,288 | B2 | | 4/2003 | Browder, Jr. et al. | |
| 6,871,516 | B2 | * | 3/2005 | Peeler | A61F 13/08 66/171 |
| 7,007,514 | B2 | * | 3/2006 | Sakai | C03B 5/2252 65/134.2 |
| 7,441,419 | B1 | * | 10/2008 | Dollyhite | A61F 13/08 66/178 A |
| 8,025,631 | B2 | | 9/2011 | Evans et al. | |
| 2009/0112138 | A1 | | 4/2009 | Evans | |
| 2011/0244748 | A1 | | 10/2011 | Evans | |
| 2012/0324961 | A1 | | 12/2012 | Clemendot | |

OTHER PUBLICATIONS

Delta-Dry the Solution that Fits Your Life, BSN medical, Rev Jun. 2011.

International Search Report for International Application No. PCT/US2013/020621 dated Nov. 28, 2013.

* cited by examiner

KNITTED COMPRESSION GARMENT, KNITTED FABRIC AND METHOD OF KNITTING FABRIC

TECHNICAL FIELD AND BACKGROUND OF THE INVENTION

The present invention relates to a therapeutic medical compression garment, a knitted fabric and a method of forming a knitted fabric. More particularly, the present invention relates to a therapeutic compression garment with structural features on the inner surface to contact the skin of the wearer. These structures increase the resistance to slipping down the limb that is characteristic of prior art hosiery products. For purposes of illustration the invention disclosed in this application refers to hosiery products used on the leg or portions of the length of the leg, and the term hosiery product, hosiery garment and stocking are used interchangeably.

Therapeutic medical compression garments are used to assist in the management of various venous and lymphatic disorders, particularly in the lower extremities of the body. The purpose of the stocking is to minimize or eliminate the effects of elevated venous pressures caused by gravity or disease processes by reducing the tendency of blood to pool in the lower extremities. This type of stocking may also be applied to inactive, bedridden individuals to reduce the occurrence of clot formation in the lower extremities that can travel to the heart or lungs where a thromboembolism may develop. This type of stocking functions by maintaining blood flow and typically has a graduated pressure profile to effect a predetermined compression of the leg sufficient to force blood upwardly out of the extremities and into circulation. External circumferential counter pressure maintains the venous and lymphatic pressures at a more normal level in the extremity, thus assisting the movement of venous blood and lymph from the extremity. Another important effect of compression is the reduction of venous volume that leads to an increase of venous flow velocity. Edema reduction and prevention is the goal in patients with chronic venous insufficiency, lymphedema, and other edema causing conditions. Subcutaneous pressures increase with elastic compression. This rise in subcutaneous tissue pressure acts to counter transcapillary forces, which favor leakage of fluid out of the capillary.

There are a variety of known therapeutic medical compression garments. However, known therapeutic stockings have a tendency to slip down the leg of the wearer, thereby detracting from the benefits of the stocking. An example of a therapeutic stocking is described in U.S. Pat. No. 3,975,929 to Fregeolle which describes a thigh length anti-embolism stocking made with alternating courses of covered spandex yarn knitted on a circular hosiery knitting machine. The stocking described in Fregeolle shows a turned welt around a portion of the top of the stocking and a narrow elastic band stitched to the upper portion of the stocking. The inner face of the elastic band is provided with beads or rows of frictional gripping material that aid in supporting the upper end of the stocking on the leg of the wearer by frictionally engaging the leg.

Another example of a therapeutic stocking is described in U.S. Pat. No. 3,874,001 to Patience, et al., which discloses a full length stocking having a foot and leg portion made from elastic. A narrow band of non-slip elastomeric webbing material is sewn onto the upper end of the leg portion by over stitching. The particular stitching used is said to provide for adequate movement of the knitting loops relative to each other to insure the deformation of the stocking as it is worn.

U.S. Pat. No. 3,983,870 to Herbert, et al. discloses a slip-resistant support for limbs, especially a medical stocking. Herbert, et al. address the slip problem by coating 20 to 30 percent of the inner surface of the knitted thread with a non-adhesive, non-continuous, relatively soft elastomeric polymeric material with a high coefficient of friction to skin so as to provide a non-occlusive slip resistant surface capable of maintaining the support in place on the limb of the body.

Yet another type of anti-embolism stocking is disclosed in U.S. Pat. No. 3,728,875 to Hartigan, et al. This stocking is knitted on a circular hosiery knitting machine and the upper portion is slit downwardly in a walewise direction and a wedge-shaped insert of soft elastic fabric is sewn into the slit to increase the circumference of the upper end of the stocking. In stockings of this type, the sewing of the wedge increases the cost of production. The insert is formed of a different compressive fabric than the remaining portion of the upper end of the stocking so that the portion of the leg covered by the insert does not receive the same compressive force as applied to the remaining portion of the leg of the wearer. The stocking also has a partial elastic retention band made with a corrugated anti-slip inner surface of urethane elastomer sewn to the upper narrow welt of the stocking and projecting above the stocking welt so that its top forms a continuous line with the top of the insert.

Therefore, it is desirable to form anti-slip portions in compression garments that on the one hand keep the garment in position on the wearer's limb and on the other hand are comfortable to wear. In order to achieve a high degree of slip resistance between the compression garment and the respective body portion, it is known to incorporate so called "friction yarns" into the knitted structure that have a high coefficient of friction with the human skin. The high slip resistance reduces the tendency of the garment to slide along the body, and thus it is not necessary that the garment apply pressures exceeding a limit acceptable for the wearer.

Publication WO 2011/116952 A1 ("Clemendot") discloses a garment portion formed entirely of a high-friction yarn incorporated into a compression garment. It is a disadvantage of this knitted structure that the surface of the anti-slip zone facing away from the user's body is also entirely formed of high-friction yarn. This outer surface can cause a garment worn on top of the compression garment to cling to the underlying compression garment and be prevented from easily sliding relative to the compression garment as the wearer moves, causing discomfort the wearer.

A more recent compression stocking is disclosed in U.S. Pat. No. 6,871,516 to Peeler et al. The stocking disclosed in Peeler is a therapeutic medical compression garment with an integrally knit anti-slip portion located in the upper area of the garment. The garment functions by placing high friction yarns directly next to the wearer's skin. The high-friction characteristics result from the texture formed on the inner side of the garment during the knitting process.

Thus, while improvements have been made to the anti-slip properties of anti-embolism garments, there remains a need for an effective, inexpensive therapeutic medical compression garment that will resist slipping down the leg of the wearer.

SUMMARY OF THE INVENTION

Therefore, it is an object of the present invention to provide a compression garment having a knitted structure forming an anti-slip portion that results in a garment that is comfortable to wear and efficiently prevents the garment from sliding along the limb on which it is worn.

It is another object of the present invention to provide a therapeutic garment having effective anti-slip properties.

It is a further object of the invention to provide a therapeutic medical compression garment which does not require sewing a separate elastomeric portion to the upper end of the garment.

It is a further object of the present invention to provide an anti-slip garment without structures that may cause high pressure at sites on the limb, such as with bulky seams, band overlaps/joints, or strips or dots of silicone.

According to one embodiment of the invention, a therapeutic medical garment is provided having a variable pressure profile along its length, and includes a knitted tubular body and a knitted anti-slip portion formed proximate one end of the tubular body with an inner surface adapted for residing against a wearer's skin. The knitted anti-slip portion includes at least first, second and third yarns simultaneously knitted to form a repeat having a raised surface texture on the inner surface of the anti-slip portion. One of the first, second and third yarns is a low-friction yarn, and two of the first, second and third yarns are high-friction yarns knitted to reside on and form the raised surface texture on the inner face of the anti-slip portion.

According to another embodiment of the invention, the low-friction yarn has a coefficient of friction of less than 0.5 and the two high-friction yarns having a coefficient of friction of greater than 0.5.

According to another embodiment of the invention, a knitted welt is formed on one end of the tubular body, and the anti-slip portion is formed intermediate the tubular body and has a textured inner surface adapted for residing in a non-slip condition against the wearer's skin to increase the anti-slip properties of the garment.

According to another embodiment of the invention, the body portion and the anti-slip portion are integrally-formed.

According to another embodiment of the invention, ground yarns of the garment comprise a jersey knit structure.

According to another embodiment of the invention, the knitted fabric is formed by separately and simultaneously feeding a first low-friction yarn, a second low-friction yarn, a first high-friction yarn and a second high-friction yarn.

According to another embodiment of the invention, the high-friction yarns have a linear mass density between 20 and 5040 denier (22.2 to 5594 dTex).

According to another embodiment of the invention, the high-friction yarns are multifilament yarns selected from the group consisting of natural rubber, synthetic rubber and spandex.

According to another embodiment of the invention, the high-friction yarns are coated with a coating material chosen from the group consisting of room temperature vulcanizing elastomer, liquid silicone coating, silicone rubber, and polyurethane elastomer.

According to another embodiment of the invention, the first high-friction yarn is knit as an inlay yarn and wherein the second high-friction yarn forms part of the knit structure and acts to lock the first high-friction yarn into the repeat.

According to another embodiment of the invention, the first high-friction yarn is knit as an inlay yarn and wherein the second high-friction yarn is knit as an inlay yarn offset to the first high-friction yarn.

According to another embodiment of the invention, the low-friction yarns are between 15 and 1200 denier (16.6 and 1332 dTex).

According to another embodiment of the invention, a therapeutic medical garment is provided having a variable pressure profile along its length, that includes a knitted tubular body and a knitted anti-slip portion formed proximate one end of the tubular body with an inner surface adapted for residing against a wearer's skin. The knitted anti-slip portion includes first, second, third and fourth yarns simultaneously knitted to form a repeat having a raised surface texture on the inner surface of the anti-slip portion. Two of the first, second, third and fourth yarns are low-friction yarns, and two of the first, second, third and fourth yarns are high-friction yarns knitted to reside on and form the raised surface texture on the inner face of the anti-slip portion.

According to another embodiment of the invention, in a repeat of the fabric structure of the anti-slip portion, the ratio between an exposed length formed by a high-friction yarn defined as $l_{fy}$ and the exposed length formed by a low-friction yarn $l_{by}$ on a contact surface of the fabric structure intended to contact a wearer' body is above r=0.3 preferably above r=0.5, most preferably above r=0.7, wherein the respective exposed lengths lx of a yarn x is defined as:

$$l_x = \sum_j (s_J \cdot k_{1,2,3})$$

and further wherein a section $s_j$ of yarn x between two points at which the yarn x is in direct contact with said contact surface, is multiplied with a factor of k1=1, a section $s_j$ yarn between a first point at which the yarn is in direct contact with a contact surface, and a second point at which a further yarn is arranged between the yarn and the contact surface, is multiplied with a factor of k2=0.5. A section $s_j$ of yarn between two points at which the yarn is not in direct contact with a contact surface, and is not considered when calculating the exposed length, i.e. k3=0.

According to another embodiment of the invention, a method is provided for forming a knitted fabric structure for a therapeutic medical garment having a variable pressure profile along its length. The method includes the steps of forming a knitted tubular body including a knitted anti-slip portion formed proximate one end of the tubular body with an inner surface adapted for residing against a wearer's skin, and having at least first, second and third yarns simultaneously knitted to form a repeat having a raised surface texture on the inner surface of the anti-slip portion. One of the first, second and third yarns is a low-friction yarn, and two of the first, second and third yarns are high-friction yarns knitted to reside on and form the raised surface texture on the inner face of the anti-slip portion. In each repeat of the anti-slip portion the ratio between an exposed length formed by a high-friction yarn is defined as $l_{fy}$ and an exposed length formed by a low-friction yarn $l_{by}$ on a contact surface of the fabric structure intended to contact a wearer' body of greater than r=0.3, wherein the respective exposed lengths lx of a yarn x is defined as:

$$l_x = \sum_j (s_J \cdot k_{1,2,3})$$

and a section $s_j$ of yarn x between two points at which the yarn x is in direct contact with said contact surface, is multiplied with a factor of k1=1. A section $s_j$ of yarn between a first point at which the yarn is in direct contact with a contact surface, and a second point at which a further yarn is arranged between the yarn and the contact surface, is multiplied with a factor of k2=0.5; and a section $s_j$ of yarn between two points at which the yarn is not in direct contact with a contact surface, is not considered when calculating the exposed length, i.e. k3=0.

According to another embodiment of the invention, the body of the garment is preferably a circular knit garment produced in any manner known to those skilled in the art, such as jersey stitches.

According to another embodiment, the anti-slip portion may be knit so as to extend only partially around the garment. Also, a knitted panel with the anti-slip portion may be separately formed and incorporated by sewing or otherwise into a garment.

BRIEF DESCRIPTION OF THE DRAWINGS

The present invention is best understood when the following detailed description of the invention is read with reference to the accompanying drawings, in which.

DETAILED DESCRIPTION OF PREFERRED EMBODIMENTS OF THE INVENTION

The knitted fabric according to the present invention is preferably produced by a conventional circular knitting process as further described below, and the resulting structure can be described as an arrangement of repeats and yarn positions within each repeat that collectively provide the desired frictional effect on the limb of the wearer.

The invention according to the garment, fabric and method of fabric formation disclosed in this application may be used in garments worn on different parts of the body, such as the leg, arm and torso, or parts of these body parts. In addition, the inventive features of the invention have application to specific parts of garments, for example, the leg or arm portions of lower body and upper body garments, such as pants and shirts.

By "variable pressure profile" is meant a characteristic of a garment that is constructed of an elastomeric material formed to exert a compressive force against a body portion, for example an leg or arm, wherein the elastomeric material provides a compressive force that is graduated from the distal area to the proximal area of the body portion. The compressive force gradient varies from a maximum value in the distal area, for example the foot or hand, to a minimum value at the proximal area. The graduated compressive force thus tends to move fluid away from the distal and towards the proximal area of the body portion to provide the desired therapeutic effect.

Figure 2:
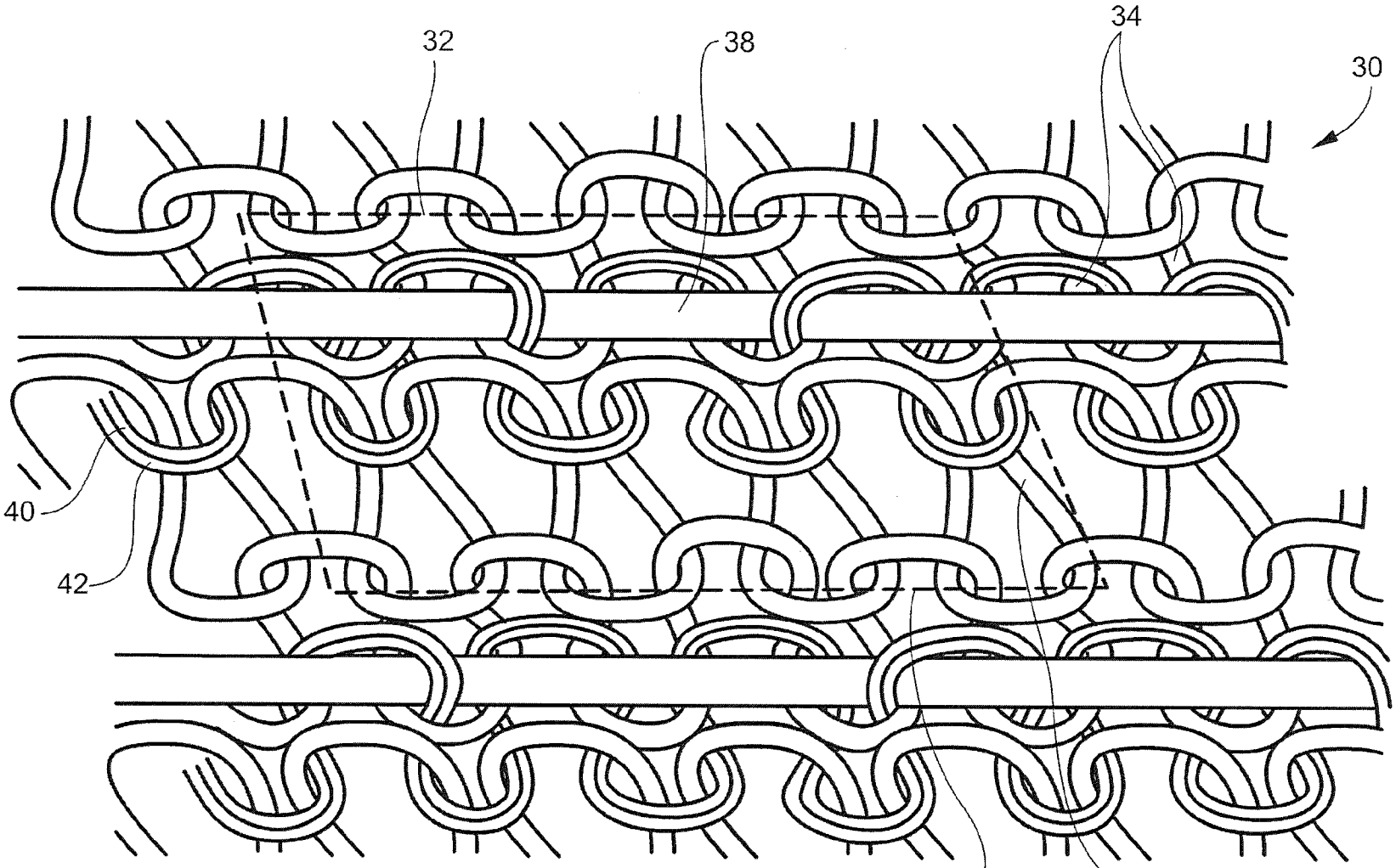
FIG. 2 shows a further embodiment of a knit structure according to the present invention.

The coefficient of friction of a yarn is determined according to the method as described in ASTM Standard D 3108-95 with the following additions. In particular, an apparatus as shown in FIG. 2 of this standard has to be used and a wrap angle of 163.5° along which the yarn in question is in contact with the rod of ceramic material identified below, the rod having a diameter of 8 mm. Finally, the pretension applied to the tested yarns was chosen to be 3.0 grams regardless of the dTex of the respective yarn. Thus, a deviation from the ATSM standard to provide a pretension below 0.04 grams per denier has been employed in order to take into account the relatively high frictional interaction between the ceramic material and the yarns in question. The values for the respective coefficients of friction are calculated based on the measured values for the input tension and the output tension as described in the standard, i.e. according to the equation specified in Section 11.4 of the ASTM standard.

The term "low-friction yarn" as used in this application refers to yarns that have a coefficient of friction in relation to a predetermined standard ceramic material below 0.5 and preferably below 0.4.

The term "high-friction yarn" as used in this application refers to yarns that have a coefficient of friction in relation to a predetermined standard ceramic material above 0.5, preferably above 0.6.

In addition, it is preferred that the structure of the present invention is knit in such a manner that when a single repeat of such a structure is considered the ratio r of the exposed lengths on an abutment surface between friction yarn and non-friction yarn exceeds r=0.3 preferably r=0.5, most preferable r=0.7.

The exposed length of the yarns are those portions of the yarns which are lying in the abutment surface and which come into direct contact with a contact surface onto which the structure is put, i.e. in case of a compression garment the respective portion of the user's body.

In this regard the respective exposed lengths $l_x$ of a yarn x is defined as:

$$l_x = \sum_j (s_J \cdot k_{1,2,3})$$

where $s_j$ are the sections of the respective yarn between contact points with the other yarns in the repeat, contact points being points at which one yarn is guided across another yarn.

For purposes of this application the standard ceramic material determined to be the desired predetermined is a ceramic product manufactured and sold by DES Ceramica Pvt. Ltd, and identified as a "normal polished" material with a surface roughness finished to 0.25-0.4 μRa, further identified at the link: http://www.desceramica.com:8080/Serface.jsp?mainlink=maincat1&parentid=160.

Another suitable material is Alsint ceramic 99,7, manufactured and sold by Bolt Technical Ceramics, a business of Morgan Technical Ceramics, division of The Morgan Crucible Company plc. Other materials, including materials designed to replicate the surface characteristics of human skin, are suitable. The suitability of the knitted structure and compression garment is determined empiracally, and then a standard against which the desired knitted structure and compression garment may be replicated is selected. It follows that there are numerous standards that may be adopted to provide the desired standard, two of which are referenced above.

Figure 1:
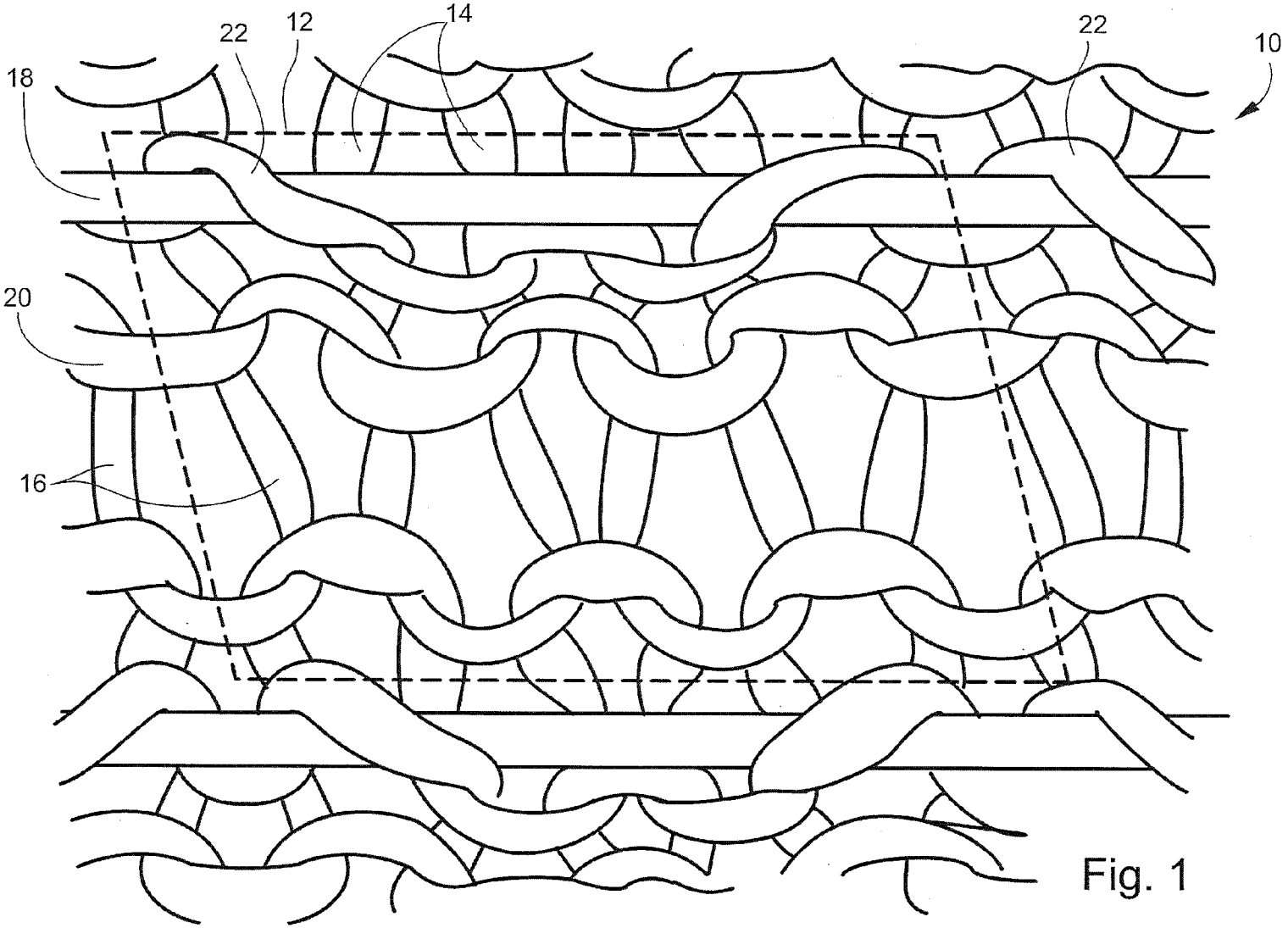
FIG. 1 shows an illustrative embodiment of a knit structure according to the present invention.

Referring now to the drawings, in FIG. 1 a first embodiment of a knit structure 10 according to the present invention is shown, and a single repeat 12 forming the pattern of this structure 10 is indicated in the box. The repeat 12 of the knit structure 10 according to the embodiment of FIG. 1 includes a first low-friction yarn 14, a second low-friction yarn 16, a first high-friction yarn 18 and a second high-friction locking yarn 20 which are knitted on a four-feed-knitting machine according to the following specification:

1st Feed: (low-friction yarn)
Textured Nylon 1/70/34; Jersey Knit
2nd Feed: (high-friction yarn)
Asahi 420d C-701 Spandex; 1×2 inlay
3rd Feed: (locking high-friction yarn)
Hyosung 140d C-100 Spandex; Jersey Knit
4th Feed: (low-friction yarn),
Stretch Polyester 1/70/34; Jersey Knit As it is clear from this specification of the pattern, the yarns 14, 16, 18, 20 are separately fed and, hence, are distinct yarns.

In general, the materials of the high-friction yarns 18, 20 may be spandex, natural rubber; synthetic rubber such as polyisoprene, styrene-butadiene rubber, styrene-ethylene/butylene-styrene and ethylene propylene diene monomer, or butyl rubber (isobutylene), in particular styrene-ethylene/butylene-styrene (S-EB-S), styrene-ethylene/propylene-styrene (S-EP-S), styrene-ethylene-ethylene/propylene-styrene (S-EEP-S), and hydrogenated styrene-isoprene/vinyl-isoprene-styrene.

In particular, the high-friction yarns 18, 20 may be Asahi 420d C-701 Spandex, Asahi 280d C-804 Spandex, Hyosung 280d H-300 Spandex, Hyosung 140d C-100 Spandex or Asahi Roica C-701 (117 D/130 dtex) (Spandex).

However, it is also possible that coated yarns are used as high-friction yarns 18, 20 wherein the following materials may be used as coating materials: Room Temperature Vulcanizing elastomers (Dow Corning® 3-3442, 3-3559, 3-7246 and 734), (Bluestar SILBIONE® TCS 7370), (Momentiv TP 3004, TP 3239, RTV 830, RTV 834, IS 5610/W130, IS 5610/60C2, and IS 5628/90), (Wacker SILPURAN® 2110, 2120 and 2130); Liquid Silicone coatings (XIAMETER® RBL-9252/LSR 250 and LSR/500), (Dow Corning 3631 LSR); Silicone Rubber (Dow Corning 7-9800 A&B, and 7-9700 A&B), (Novagard's 800-240 and 800-142) and Polyurethane Elastomeric coatings (Bayer Material Science BAYMEDIX, IMPRANIL HS-85 LN, IMPRANIL DAH, IMPRANIL LP RSC 4002, BAYHYDROL 124, BAYHYDROL UH 240 and BAYHYDROLU XP 2428).

The high-friction yarns 18, 20 have a coefficient of friction in relation to the above-specified ceramic material above 0.5 and preferably above 0.6, this coefficient being measured according to the above-described method. In addition, the high-friction yarns are preferably between 20 and 5040 denier (22.2 to 5594 dTex).

The low-friction yarns 14, 16 of this structure 10 may in general be 4/70/48 Textured Nylon, S or Z twist; 1/70/34 Stretch Polyester; 4/70/68 Textured Nylon, S or Z twist; Covered Yarn 70 core 55-35DC, 1/70/34 Textured Nylon, S or Z twist; Dri-Release 85% Polyester 15% Cotton, Dri-Release 88% Polyester 12% Wool and Supima Cotton 26/1 Spun.

The placement of yarns in the knit structure 10 of FIG. 1 provides for sufficient stiffness to generate a predetermined desired resistance to slippage of the fabric when being worn. More specifically, the first and second high-friction yarns 18, 20 result in a higher overall length along which these high-friction yarns of the fabric extend when being worn.

In particular, in this knit structure 10 the effect of "shadowing" the first high-friction yarn 18 by the second, locking high-friction yarn 20, is distinctively different than the prior art. As shown in FIG. 1, the high-friction yarn 18 is covered by the second high-friction yarn 20 only at points 22 where the second, locking high-friction yarn 20 is used to lock the first high-friction yarn 18 to the fabric structure 10. Thus, the overall effective length of high-friction yarns 18, 20 in direct contact with the wearer is increased compared to the prior art.

The ratio r between the exposed length of the low-friction yarns 14, 16 and the high-friction yarns 18, 20 can be calculated in accordance with the above-specified method. For this purpose the shape of each yarn in the repeat 12 is separated into a plurality of sections $s_j$ which for the purpose of the following calculations are considered to have an identical length. Each section $s_j$ extends from one contact point 22 with a further yarn to the next contact point 22, and this is illustrated for sections $s_1$, $s_2$ and $s_3$ of a portion of the second high-friction yarn 20 in FIG. 1.

For each of these sections the corresponding factor $k_{1,2,3}$ is determined according to the following rules:

a) If a section $s_j$ of the second high-friction yarn 20 extends between two contact points 22 with further yarns (in case of the present portion this is only the second low-friction yarn 16) at which points the second high-friction yarn 20 would be in direct contact with a contact surface such as the wearer, the factor is $k_1=1$;

b) If a section $s_j$ of the second high-friction yarn 20 extends between a first contact point 22 at which the second high-friction yarn 20 is in direct contact with a contact surface, and a second contact point 22 at which the second low-friction yarn 16 is arranged between the second high-friction yarn 20 and the contact surface, the factor is $k_2=0.5$; and c) If a section $s_j$ of the second high-friction yarn 20 extends between two points at which the second high-friction yarn 20 is not in direct contact with a contact surface, it is not considered when calculating the exposed length, i.e. $k_3=0$.

If these rules are applied to the portion of the second high-friction yarn 20 including the sections $s_1$, $s_2$ and $s_3$ this results for $s_1$ in $k_1=0.5$, for $s_2k_1=11$ and for $s_3k_1=0.5$. Thus, the exposed length l for this portion only would be $l=s_1k_1+s_2k_1+s_3k_1=1\times0.5+1\times1+1\times0.5=2$.

In this way the exposed length for each yarns 14, 16, 18, 20 in the repeat 12 can be calculated. When the exposed lengths $l_{by1}$, $l_{by2}$, $l_{fy1}$, $l_{fy2}$ for the first low-friction yarn 14, for the second low-friction yarn 16, for the first high-friction yarn 18 and for the second high-friction yarn 20 have been derived from the structure 10, the ratio r between the exposed length of high-friction yarn 18, 20 and the exposed length of low-friction yarns 14, 16 can be calculated according to:

$$r = \frac{l_{fy1} + l_{fy2}}{l_{by1} + l_{by2}}$$

For the structure 10 according to the first embodiment this results in r=0.86 whereas the structure described in the Peeler reference has a ratio between the exposed lengths of r=0.22. Thus, the structure 10 of the FIG. 1 embodiment results in a higher portion of high-friction yarn being in direct contact with the wearer when the structure 10 is part of a compression garment so that the anti-slip effect is increased compared to the prior art even though low-friction yarns 14, 16 are also employed.

Referring now to FIG. 2, a fabric structure 30 according to a second embodiment of the present invention is shown. Similar to fabric structure 10, repeat 32 of the knit structure 30 comprises a first low-friction yarn 34, a second low-friction yarn 36, a first high-friction yarn 38, a second high-friction yarn 40 and a third low-friction yarn 42, and these yarns are knitted according to the following specification for a four-feed-knitting machine:

1st Feed: (low-friction yarn)
Textured Nylon 1/70/34; Jersey Knit
2nd Feed: (high-friction yarn)
Asahi 420d C-701 Spandex; 2×2 inlay
3rd Feed: (high-friction and low-friction locking yarns)
Hyosung 140d C-100 Spandex (friction yarn) and nylon 2/20/7 (low-friction yarn); 3×1 rib
4th Feed: (low-friction yarn)
Textured Nylon 1/70/34; Jersey Knit Thus, the yarns, 34, 36, 38, 40 and 42 are also separately fed and this structure 30 includes besides the low-friction yarns 34, 36 and 42 at least two high-friction yarns 38, 40 separately knit as well which are responsible for the anti-slip effect of this fabric structure 30.

The yarns 34, 36, 38, 40 and 42 employed in this structure 30 may be chosen from the same groups as in the case of the first structure 10. Finally, the coefficient of friction of the first and second high-friction yarns 38, 40 in relation to a ceramic material referenced above determined according to the aforementioned method should be above 0.5 and preferably above 0.6.

When the ratio r in the repeat 32 of the exposed lengths for the low-friction yarns 34, 36 and the high-friction yarns 38, 40/42 is calculated for the second structure 30 the result is r=0.78 and, hence, well above the value known from a prior art structure comprising body and high-friction yarns.

Figure 3:
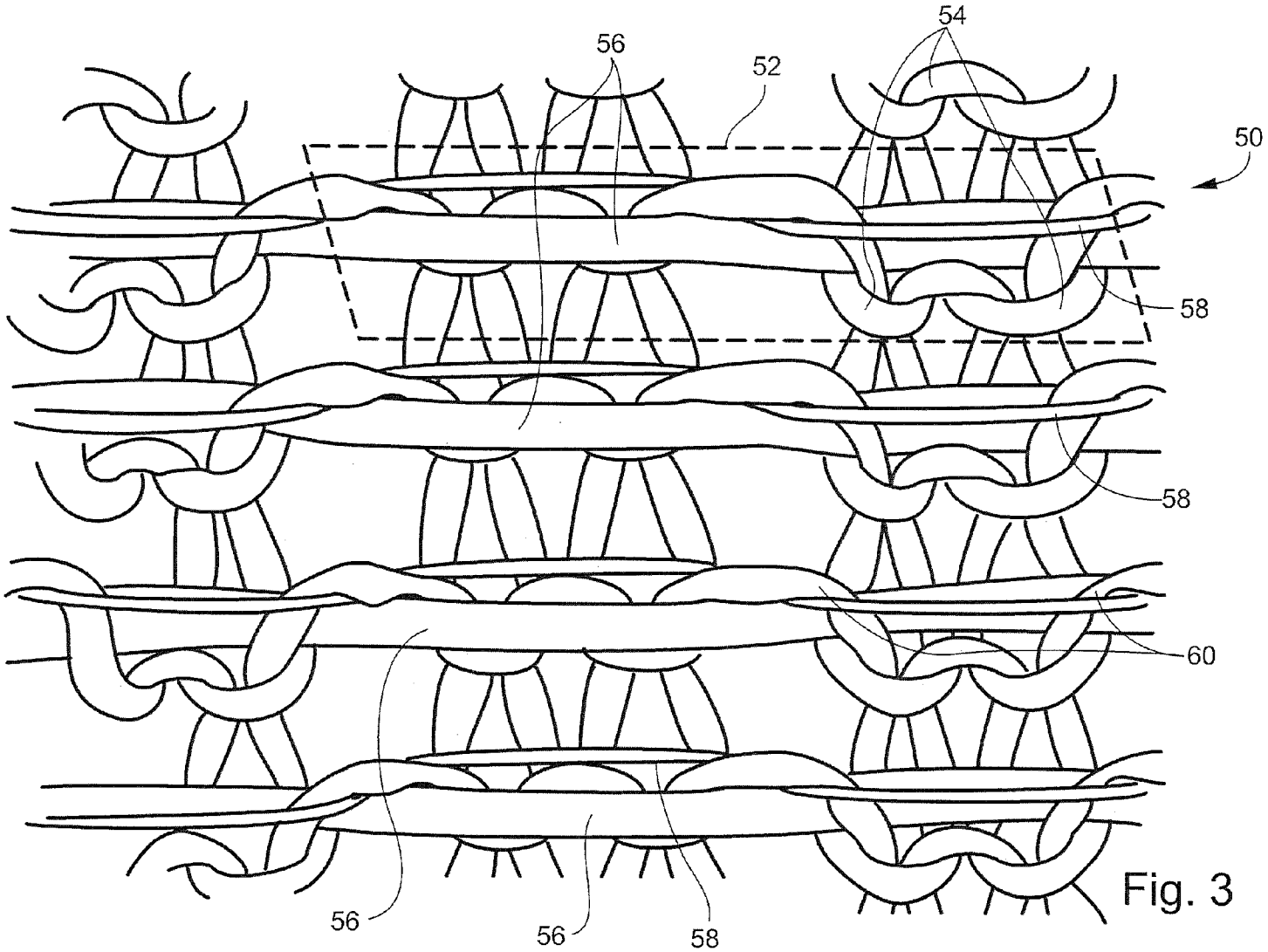
FIG. 3 shows a further embodiment of a knit structure according to the present invention.

Referring now to FIG. 3, a fabric structure 50 according to a third embodiment of the present invention is shown. As with fabric structures 10 and 30, a repeat 52 of the third knit structure 50 also includes a first low-friction yarn 54, a first high-friction yarn 56 and a second high-friction yarn 58. Although knit on a four-feed-knitting machine, this fabric structure 50 is achieved by feeding only three yarns, so that the yarns 54, 56, 58 are knit according to the following specification:

1st Feed: (low-friction yarn)
Textured Nylon 1/70/34; Jersey Knit
2nd Feed: (high-friction yarn)
Asahi 420d C-701 Spandex; 2×2 inlay
4th Feed: (high-friction yarn)
Spandex 117D C-701; 2×2 alternate inlay The yarns are separately fed and in addition to the low-friction yarn 54 the fabric structure 50 comprises two high-friction yarns 56, 58, separately knit.

As in the case of the aforementioned embodiments the yarns 54, 56, 58 employed in this fabric structure 50 are chosen from the same groups as in case of the first and second structures 10 and 30. In particular, the coefficient of friction of the first and second high-friction yarns 56, 58 in relation to the ceramic materials referenced above and determined according to the aforementioned method is above 0.5 and preferably above 0.6.

As shown in FIG. 3, both the first and the second high-friction yarns 56, 58 are knit as floats in such a manner that at points 60 where the first high-friction yarn 56 is covered by a low-friction yarn 54, the second high-friction yarn 58 is on top of that low-friction yarn 54 so that it is ensured at least high-friction yarn 56 will come into contact with the wearer at the respective points 60.

The ratio r in the repeat 52 of the exposed lengths for the low-friction yarn 54 and the high-friction yarns 56, 58 can be calculated for the third structure 50, as well to achieve a very desirable value of r=1.04.

Figure 4:
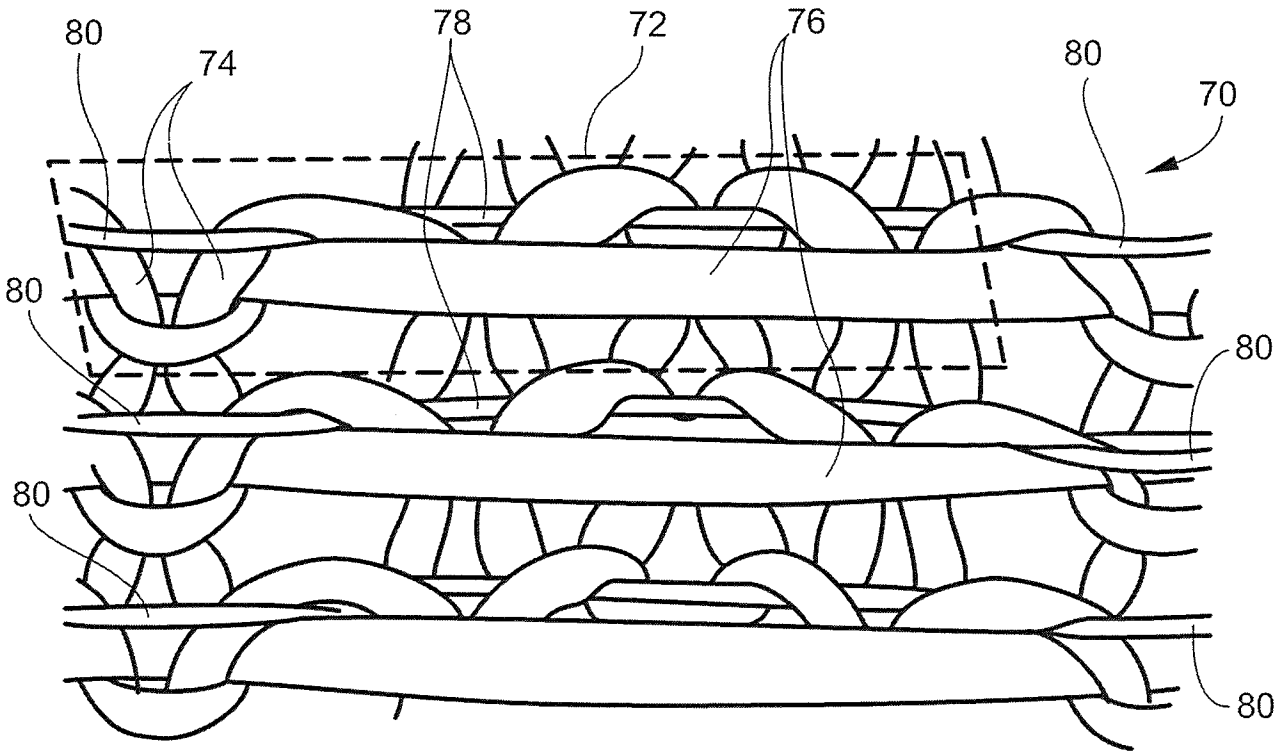
FIG. 4 shows a further embodiment of a knit structure according to the present invention.

Referring now to FIG. 4, a fabric structure 70 according to a fourth embodiment of the present invention is shown. As is shown with reference to repeat 72, the knitted fabric structure 70 comprises a low-friction yarn 74, a first high-friction yarn 76 and a second high-friction yarn 78. Fabric structure 70 is knit according to the following specification:

1st Feed: (low-friction yarn)
Textured Nylon 1/70/34; Jersey Knit
2nd Feed: (high-friction yarn)
Asahi 420d C-701 Spandex; 3×1 inlay
4th Feed: (high-friction yarn)
Spandex 117D C-701; 1×1 inlay As in the case of the previously-described embodiments, the yarns 74, 76, 78 employed in this fabric structure 70 are chosen from the same groups as in case of the first and second and third fabric structures 10, 30, and 50. In particular, the coefficient of friction of the first and second high-friction yarns 76, 78 in relation to the ceramic materials referenced above and determined according to the aforementioned method is above 0.5 and preferably above 0.6.

As shown in FIG. 4, both the first and the second high-friction yarns 76, 78 are knit as floats in such a manner that at points 80 where the first high-friction yarn 76 is covered by a low-friction yarn 74, the second high-friction yarn 78 is on top of that low-friction yarn 74 so that it is ensured at least one high-friction yarn 78 will come into contact with the wearer at the respective points 80.

The ratio r in the repeat 72 of the exposed lengths for the low-friction yarn 74 and the high-friction yarns 76, 78 is calculated for the fabric structure 70, to achieve a very desirable value of r=1.20.

Figure 5:
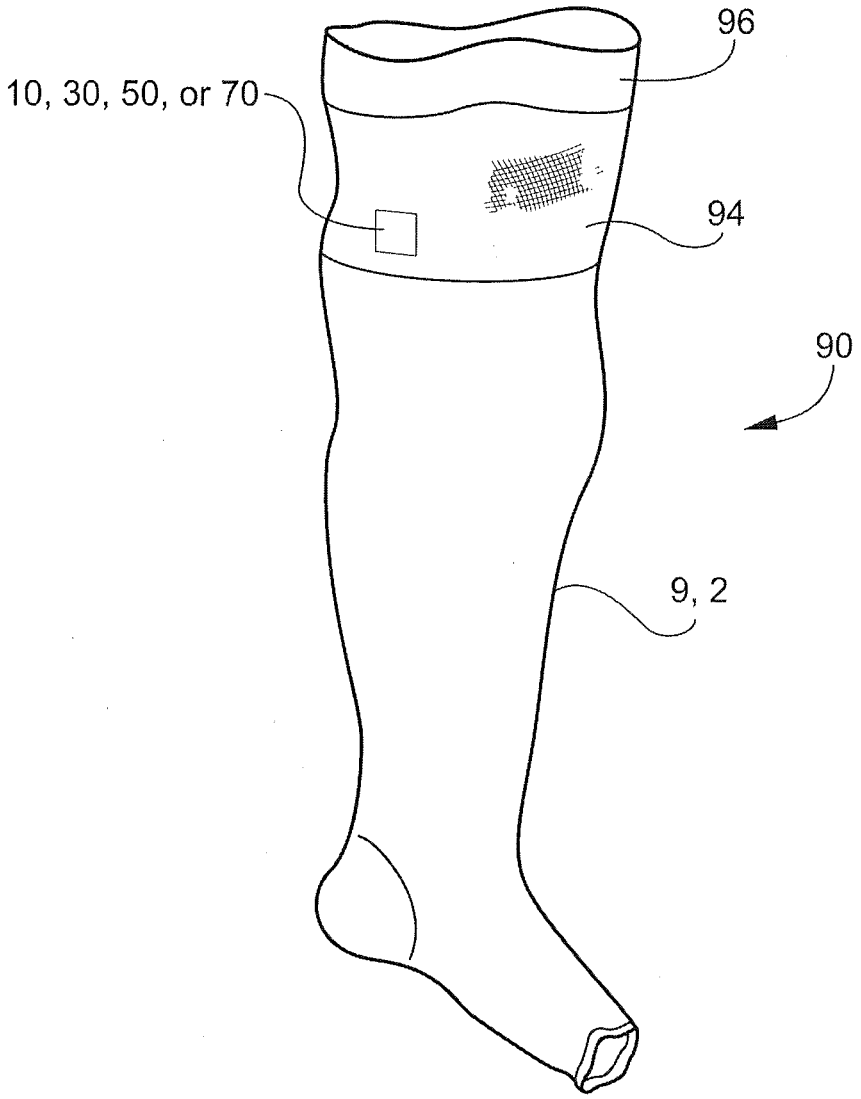
FIG. 5 illustrates one form of compression garment, which may be fabricated of any of the fabric constructions illustrated in FIGS. 1-4, among others, and according to the method described in this application.

Referring now to FIG. 5, a therapeutic medical compression garment in the form of a compression stocking is shown broadly at reference numeral 90. While, as noted above, the invention is described in this application for purposes of illustration as a compression stocking with a variable pressure profile, the invention also includes any garments, such as stockings, sleeves, and the like, for use on a patient to assist in the management of venous or lymphatic disorders and/or thrombosis in the limb or torso of a patient.

Stocking 90 according to the particular embodiment of FIG. 5 has a body portion 92, an anti-slip portion 94 integrally formed to the body portion 92 located proximate the upper end of the stocking 90, and an optional welt 96 at the top end of the stocking 90. The optional welt 96 is principally intended to prevent the topmost upper extent of the stocking 90 from rolling down over on itself and forming an undesirable thicker area but may be omitted from the construction if desired, in which case the anti-slip portion 94 forms the upper extremity of the stocking 90.

The anti-slip portion 94 may be knitted so as to extend only partially around the garment. Also, a knitted panel with an anti-slip portion such as anti-slip portion 94 may be separately formed and incorporated by sewing or otherwise into a garment.

The body portion 92 of the stocking 90 is preferably circular knit in a manner known to those skilled in the art, for example, utilizing jersey stitches. The stretchable textured yarns described above are knit in jersey courses. The stocking 90 may be knitted on any conventional knitting machine, such as a Santoni Pendolina medical knitting machine or a Lonati La-ME medical knitting machine.

The anti-slip portion 94 is knitted in accordance with one of the fabric structures 10, 30, 50 or 70, and several embodiments of the yarn construction and knit construction for two frequently used knitting machines is set out below by way of further example to those yarn and knit constructions set out above:

Yarn Construction: "Santoni Pendolina Medical Knitting Machine"

1st Feed: 1/70/34 Stretch Nylon (S Twist)
2nd Feed: Roica C-701-420 denier Spandex 3rd Feed: Hyosung C-100-140 denier Spandex
4th Feed: 1/70/34 Stretch Polyester Yarn Construction: "Lonati LA-ME Knitting Machine"

4th Feed: 1/70/34 Stretch Nylon (S Twist)
1st Feed: Roica C-701-420 denier Spandex
3rd Feed: Roica C-701-117 denier Spandex Knit Construction: "Santoni Pendolina Medical Knitting Machine"

1st Feed: Jersey knit on all needles
2nd Feed: 1×2 inlay (tuck height)
3rd Feed: Jersey knit on all needles
4th Feed: Jersey knit on all needles Knit Construction: "Lonati LA-ME Medical Knitting Machine"

4th Feed: Jersey knit on all needles
1st Feed: 2×2 inlay (tuck height)
3rd Feed: 2×2 alternate inlay (tuck height)

The structures 10, 30, 50 and 70 described by way of example above allow an increase in the surface portion of the garment, for example the stocking 90, facing the wearer's body to be formed of high-friction yarn, as the second high-friction yarn may be utilized to lock the first high-friction yarn to the knit structure and vice versa, so that the high-friction yarns are not shielded by one or more low-friction yarns and form a raised surface profile on the inner face of the stocking 90. The raised surface texture results from knitting the fabric such that the high-friction yarns of the anti-slip portion 94 are formed as "floats" on the inner face of the fabric that are raised above the surrounding ground yarns to form a surface texture that provides the desired relatively high-friction, anti-slip characteristic against the wearer's skin.

Moreover, the fabric structures 10, 30, 50 and 70 are arranged such that the surface of the stocking 90 facing away from the wearer is principally low-friction yarns, so that the high-friction yarns do not cause objectionable cling between the stocking 90 and other clothing items such as skirts, dresses and pants worn on over the stocking 90.

The knit structure achieved by the invention provides for sufficient stiffness to generate a predetermined pressure, and the first and second high-friction yarns result in a higher overall length along which high-friction yarn is in contact with the user's body. Thus, even a moderate pressure may already generate sufficient slip resistance as the contact length of high-friction yarn is higher compared to the prior art structures.

A therapeutic medical garment, knitted fabric and method of forming a therapeutic medical garment according to the invention have been described with reference to specific embodiments and examples. Various details of the invention may be changed without departing from the scope of the invention. Furthermore, the foregoing description of the preferred embodiments of the invention and best mode for practicing the invention are provided for the purpose of illustration only and not for the purpose of limitation.

We claim:

1. A therapeutic medical garment having a variable pressure profile along a length thereof, and comprising:

(a) a knitted tubular body;

(b) a knitted anti-slip portion formed proximate one end of the knitted tubular body with an inner surface adapted for residing against a wearer's skin;

(c) the knitted anti-slip portion including at least first, second and third yarns simultaneously knitted to form a repeat having a raised surface texture on the inner surface of the knitted anti-slip portion, wherein the first yarn is a low-friction yarn, and further wherein the second yarn and the third yarn are high-friction yarns knitted to reside on and form the raised surface texture on the inner face of the anti-slip portion such that the second yarn is covered by the third yarn at points where the third yarn locks the second yarn to the knitted anti-slip portion.

2. A therapeutic medical garment according to claim 1 wherein the first yarn has a coefficient of friction of less than 0.5 and the second yarn and the third yarn have a coefficient of friction of greater than 0.5.

3. A therapeutic medical garment according to claim 1 or claim 2, and including:

(a) a knitted welt formed on one end of the knitted tubular body; and (b) the knitted anti-slip portion formed intermediate the knitted tubular body and the knitted welt having a textured inner surface adapted for residing in a non-slip condition against the wearer's skin to increase the anti-slip properties of the therapeutic medical garment.

4. A therapeutic garment according to claim 3, wherein the knitted tubular body and the knitted anti-slip portion are integrally-formed.

5. A therapeutic garment according to claim 4, wherein the knitted tubular body is a jersey knit structure.

6. A therapeutic garment according to claim 1, wherein the second and third yarns have a linear mass density between 20 and 5040 denier (22.2 to 5594 dTex).

7. A therapeutic garment according to claim 1, wherein the second and third yarns are multifilament yarns selected from the group consisting of natural rubber, synthetic rubber and spandex.

8. A therapeutic garment according to claim 1, wherein the second and third yarns are coated with a coating material selected from the group consisting of room temperature vulcanizing elastomer, liquid silicone coating, silicone rubber, and polyurethane elastomer.

9. A therapeutic garment according to claim 1, wherein the second yarn is knit as an inlay yarn and wherein the third yarn forms part of the knit structure and acts to lock the first high-friction yarn into the repeat.

10. A therapeutic garment according to claim 1, wherein the second yarn is knit as an inlay yarn and wherein the third yarn is knit as an inlay yarn offset to the second yarn.

11. A therapeutic garment according to claim 1, wherein the first yarn is between 15 and 1200 denier (16.6 and 1332 dTex).

12. A therapeutic medical garment having a variable pressure profile along a length thereof, and comprising:

(a) a knitted tubular body;

(b) a knitted anti-slip portion formed proximate one end of the knitted tubular body with an inner surface adapted for residing against a wearer's skin;

(c) the knitted anti-slip portion including first, second, third and fourth yarns simultaneously knitted to form a repeat having a raised surface texture on the inner surface of the knitted anti-slip portion, wherein the first yarn and the second yarns are low-friction yarns, and further wherein the third yarn and the fourth yarn are high-friction yarns knitted to reside on and form the raised surface texture on the inner face of the knitted anti-slip portion such that the third yarn is covered by the fourth yarn at points where the fourth yarn locks the third yarn to the knitted anti-slip portion.

13. A therapeutic medical garment according to claim 12, wherein in a repeat of the knitted anti-slip portion a ratio between an exposed length formed by a high-friction yarn defined as $l_{fy}$ and an exposed length formed by a low-friction yarn $l_{by}$ on a contact surface of the knitted fabric structure intended to contact a wearer' body is above r=0.3 , wherein the respective exposed lengths $l_x$ of a yarn x is defined as:

$$l_x = \sum_j (s_J \cdot k_{1,2,3})$$

wherein:

a) a section $s_j$ of yarn x between two points at which the yarn x is in direct contact with said contact surface, is multiplied with a factor of $k_1=1$;

b) a section $s_j$ of yarn between a first point at which the yarn is in direct contact with a contact surface, and a second point at which a further yarn is arranged between the yarn and the contact surface, is multiplied with a factor of $k_2=0.5$; and c) a section $s_j$ of yarn between two points at which the yarn is not in direct contact with a contact surface, is not considered when calculating the exposed length, i.e. $k_3=0$.

14. A method of forming a knitted fabric structure for a therapeutic medical garment having a variable pressure profile along a length thereof, comprising the steps of:

(a) forming a knitted tubular body including a knitted anti-slip portion formed proximate one end of the knitted tubular body with an inner surface adapted for residing against a wearer's skin, and having at least first, second and third yarns simultaneously knitted to form a repeat having a raised surface texture on the inner surface of the anti-slip portion, wherein the first yarn is a low-friction yarn, and further wherein the second yarn and the third yarn are high-friction yarns knitted to reside on and form the raised surface texture on the inner face of the anti-slip portion such that the second yarn is covered by the third yarn at points where the third yarn locks the second yarn to the knitted anti-slip portion; and (b) providing in each repeat of the knitted anti-slip portion a ratio between an exposed length formed by a high-friction yarn defined as $l_{fy}$ and an exposed length formed by a low-friction yarn $l_{by}$ on a contact surface of the fabric structure intended to contact a wearer' body of greater than r=0.3, wherein the respective exposed lengths $l_x$ of a yarn x is defined as:

$$l_x = \sum_j (s_J \cdot k_{1,2,3})$$

and further wherein:

i) a section $s_j$ of yarn x between two points at which the yarn x is in direct contact with said contact surface, is multiplied with a factor of $k_1=1$;

ii) a section $s_j$ of yarn between a first point at which the yarn is in direct contact with a contact surface, and a second point at which a further yarn is arranged between the yarn and the contact surface, is multiplied with a factor of $k_2=0.5$; and iii) a section $s_j$ of yarn between two points at which the yarn is not in direct contact with a contact surface, is not considered when calculating the exposed length, i.e. $k_3=0$.

* * * * *